United States Patent [19]

Niznik

[11] 3,940,921

[45] Mar. 2, 1976

[54] FRICTION DETENT TO PERMIT SETTING OF DIGITAL CLOCK

[75] Inventor: Emil John Niznik, Lake Geneva, Wis.

[73] Assignee: Bunker Ramo Corporation, Oak Brook, Ill.

[22] Filed: Apr. 9, 1975

[21] Appl. No.: 566,565

[52] U.S. Cl. ..... 58/85.5; 58/125 C; 58/126 E; 235/133 R

[51] Int. Cl.[2] ..... G04B 27/08; G04B 19/02

[58] Field of Search ..... 58/85.5, 125 C, 126 E; 235/140, 139 R, 137, 135, 133 R

[56] References Cited

UNITED STATES PATENTS

| | | | |
|---|---|---|---|
| 2,959,914 | 11/1960 | Harada | 58/85.5 X |
| 3,690,063 | 9/1972 | Strachan | 58/125 C |
| 3,721,086 | 3/1973 | Flumm | 58/125 |

*Primary Examiner*—George H. Miller, Jr.
*Assistant Examiner*—U. Weldon
*Attorney, Agent, or Firm*—D. R. Bair; F. M. Arbuckle

[57] ABSTRACT

In a rotating drum type of digital clock, the minute drum is fixed to the drum shaft. A drive disc is carried on the shaft, freely rotatable thereon, adjacent to the minute drum. Sandwiched between them is a detent ring which is keyed to the drive disc, but which has limited axial freedom with respect to both the disc and the drum, being pressed toward the web of the drum by a spring. Convex detent bosses extending axially from the ring can engage with any of a plurality of recesses in the web of the minute drum. The drive disc is advanced each minute by the normal actuating mechanism, and drives the minute drum through the detent ring. A setting knob is engageable with the shaft, permitting rotation of the latter, and hence of the minute drum, for setting purposes. In setting, the bosses are forced out of the recesses, the ring retracting axially, so that the drum can be rotated with respect to the ring. As a setting is completed, the bosses will drop again into recesses, thus indexing the drum to provide proper full-figure display of the numerals on its periphery.

11 Claims, 8 Drawing Figures

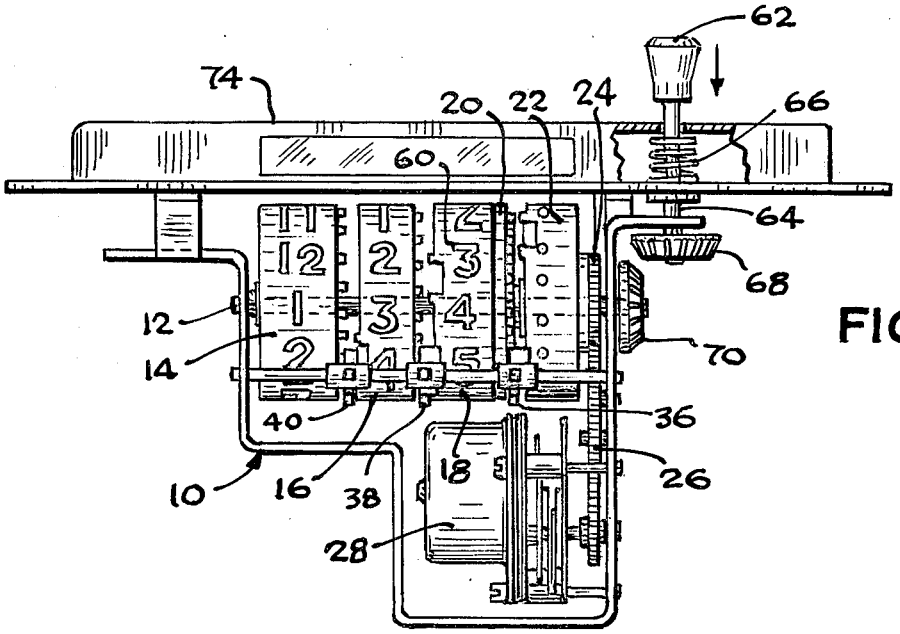
FIG.1
FIG.2
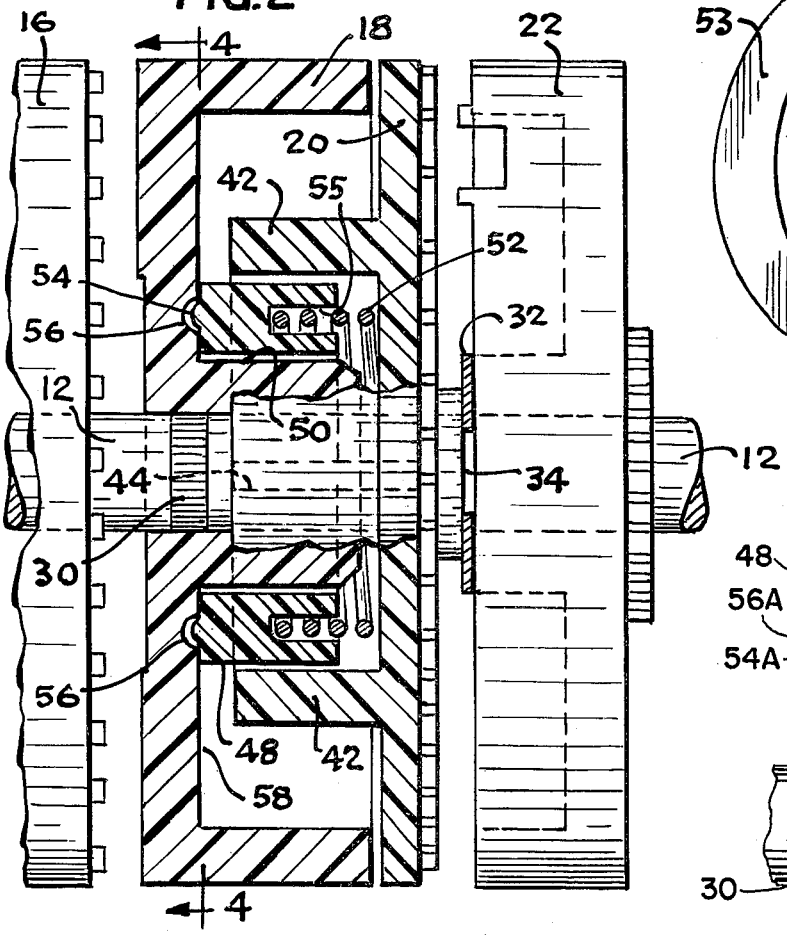
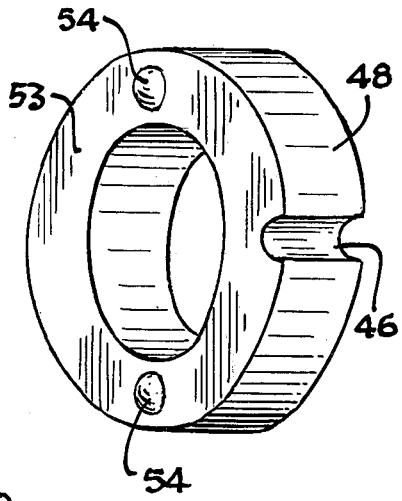
FIG.3
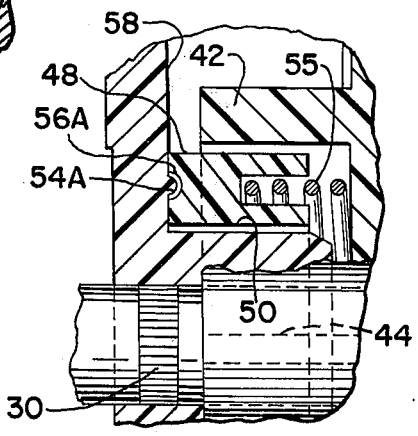
FIG. 2A

FRICTION DETENT TO PERMIT SETTING OF DIGITAL CLOCK

In a drum type of digital clock it is necessary to have a friction clutch or some similar device which will permit rotation of the drums for setting the clock to a desired indication by manual means, without damage to the normal drive mechanism. In addition, it is desirable to have some sort of indexing or detent device which causes the numerals to be displayed properly centered vertically in the exposing aperture.

The present invention accomplishes both of these desired results, and has several advantages over known arrangements for accomplishing the same results. It eliminates the problem of fatigue, weakening and breakage of spring fingers such as are used in some known mechanisms. It provides an indexing means which requires substantially the same torque for setting in either direction, thus overcoming the disadvantage of prior art detents such as drag levers or leaf springs, which may require noticeably greater torque for setting in one direction than in the other.

Most importantly, its peak setting torque requirement comes at the point where the drum is leaving an indexed position, and after the peak point is passed, the torque requirement is relatively low until the next index position is reached. Hence an index position is the point at which the user is most likely to stop in making a setting adjustment, because there is a "hump" to be overcome before the drum can be rotated further. In some other detent indexing systems, there is a peak torque requirement somewhere between index positions, with an increased likelihood that the user may stop the setting action with the drum numerals overlapping in the exposure aperture.

The present invention is applicable to a rotating drum type of digital clock in which there is an hour drum, a ten minute drum with numerals 0 to 5, and a minute drum with numerals 0 to 9. A seconds drum may or may not be provided.

The minute drum is fixed to the drum shaft. A drive disc is mounted for free rotation upon the shaft, next to the minute drum on the side thereof opposite to the 10 minute drum. Sandwiched between them is a detent ring which is keyed to the drive disc, but which has limited axial freedom with respect to both the disc and the drum, being pressed toward the web of the drum by a spring. Detent bosses extend axially from the ring, and are engageable with any of a plurality of recesses formed in the web of the minute drum. The drive disc is advanced each minute by the normal actuating mechanism, and drives the minute drum through the detent ring, by reason of the engagement of the bosses in the recesses of the minute drum.

A setting knob has a spindle which is engageable with the drum shaft, permitting rotation of the latter, and hence of the minute drum, for setting purposes. When the drum shaft is manually rotated in this way, it rotates the minute drum, which in turn advances or sets back the other drums in the train, according to whether the setting action is forward or back.

When torque is manually applied to the drum shaft in the setting operation, rotation of the minute drum causes the bosses of the drive disc to be forced out of the recesses, the ring retracting axially against the spring, so that the drum can be rotated with respect to the ring, without damage to the normal drive mechanism As a setting is completed, the tendency is for the user to stop the application of force at a point where the bosses have dropped again into recesses, thus indexing the drum to provide proper full-figure display of the numerals on its periphery in the exposure aperture.

BRIEF DESCRIPTION OF THE DRAWING

In the accompanying drawings:

FIG. 1 is a bottom view of a digital clock mechanism such as has been referred to above;

FIG. 2 is an enlarged sectional view through the minute drum of such a clock mechanism, illustrating an embodiment of the present invention therein, the adjacent drums and part of the drive disc being shown in elevation;

FIG. 2A is a fragmentary sectional view, similar to the center portion of FIG. 2, illustrating an alternate form of the detent means;

FIG. 3 is an enlarged perspective view of the detent ring;

In the drawings, FIG. 1 shows a digital clock mechanism of generally conventional design, in which a frame 10 carries a drum shaft 12 on which time indicating drums including an hour drum 14, a 10-minute drum 16, and a minute drum 18 are mounted for rotation in axially spaced relation to one another, the minute drum having a drive disc 20 associated with it. A seconds drum 22 may also be provided, with a gear 24 mounted thereon or integral therewith, by which the drum 22 is driven through a train of gears 26 from the motor 28.

In FIG. 2, the minute drum 18 and associated parts are shown on an enlarged scale. The minute drum is fixed on the shaft 12 by being pressed onto a knurled portion 30 thereof. All other drums, 14, 16 and 22 are freely rotatable with respect to the shaft. The drive disc 20 is also freely rotatable on the shaft, and is held in close relation to the drum 18 by a C-clip 32 fitting in a groove 34 in the shaft.

Figure 4:
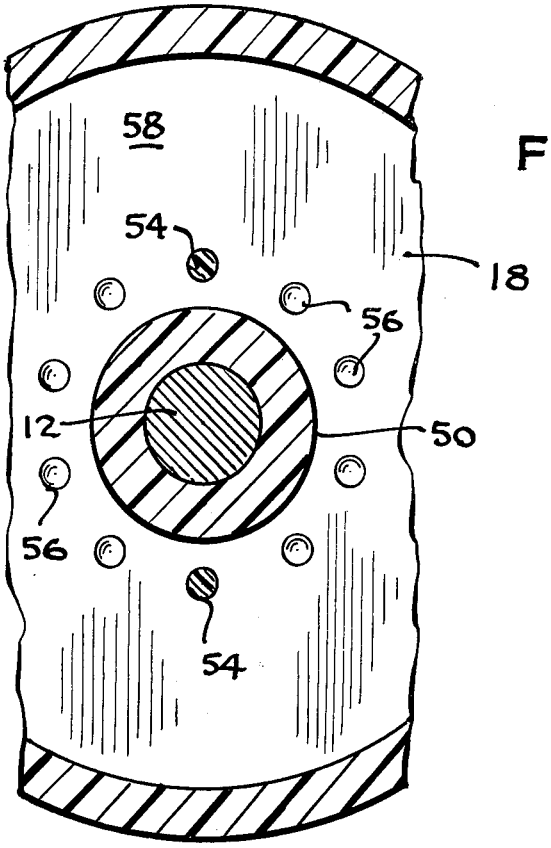
FIG. 4 is a fragmentary sectional view taken on the line 4—4 of FIG. 2.

Normal drive of the drum train is from seconds drum 22 through indexing gear 36 (FIG. 1), by which the seconds drum advances the drive disc 20 (and thereby the minute drum) one-tenth of a revolution for each revolution of the seconds drum. In well-known manner, which need not be further described, the minute drum through indexing gear 38 advances the 10-minute drum, which in turn through indexing gear 40 advances the hour drum.

As seen in FIG. 2, the drive disc 20 has an annular flange 42 extending axially within the minute drum 18 toward the web 58 thereof. Internally this flange has an axially extending key 44, which fits in driving engagement with a keyway 46 (FIG. 3) in a detent ring member 48, causing the ring to rotate at all times in just the same way as the disc 20. The ring 48 is dimensioned to provide a sliding fit within the annular flange 42, and likewise on the hub 50 of the minute drum, so that although constrained rotationally by the keyway 46, it can move axially to a limited extent. The end face 53 of the ring has convex bosses or projections 54 at such a radius from the shaft as to engage with concave recesses 56 in the adjacent web 58 of the minute drum. In the ordinary case, where there are ten numerals 60 on the periphery of the minute drum (0–9), ten recesses 56 are provided, equidistant from the shaft 12, and equiangularly spaced, as seen in FIG. 4. A coil spring 52, partly contained in a recess 55 in the detent ring, bears against the disc 20 and against the bottom of the recess 55. The disc 20 is restrained by the C-clip 32 against movement to the right (FIG. 2) and the spring tends to move the ring 48 toward the web 58 of the minute drum. This bias by the spring causes the projections 54 to enter into the recesses 56 (when they come into register therewith) with a detent action which is sufficient to drive the minute drum 18 and the succeeding drums 16 and 14 in the drum train when the drive disc 20 is rotated.

In FIG. 2A an alternate arrangement of the detent means is shown, in which the projections 54A are provided on the web 58 of the drum 18, and recesses 56A are formed in the detent ring 48. The other parts are substantially the same as above described;

When it is desired to set the clock, depressing a setting knob 62 in the direction of the arrow (FIG. 1) moves the setting spindle 64 axially against the influence of a spring 66, and brings bevel gear 68 on the spindle into engagement with bevel gear 70 on shaft 12. Rotation of knob 62 then causes rotation of the shaft 12, and consequently of minute drum 18 while the drive disc 20 and detent ring 48 are constrained against rotation by the indexing gear 36. The torque exerted in setting is enough to force the projections 54 to withdraw from the recesses 56 against the biasing influence of spring 52. The projections and/or the recesses at their intersections with the adjacent plane surfaces of the end 53 of the ring and of the web 58, respectively, have angles such as to permit this. Preferably the projections 54 are provided in diametrically opposite pairs, as shown in FIGS. 3 and 4, or in other symmetrical arrangement, so that in the withdrawing movement there is no tendency to cock or tilt the ring 48, which might cause it to bind within the flange 42 or on the hub 50.

When the minute drum is rotated with respect to the detent ring in setting, the projections drop into the recesses as each opposite pair of recesses is encountered, and there is thus a definite indexing effect. It will be apparent that the greatest torque requirement is at the indexed position, when the projection is being forced to climb out of the recess against the bias of the spring. Once the projection has been raised out of the recess, however, a relatively low and uniform torque is all that is necessary to further rotate the minute drum, with the projections 54 sliding along the smooth surface of the web 58 until they drop into the next pair of recesses. For this reason, when a setting operation is completed, the user is most likely to stop applying force at one of the indexing points, i.e., where the projections are engaged in a recess.

Figure 7:
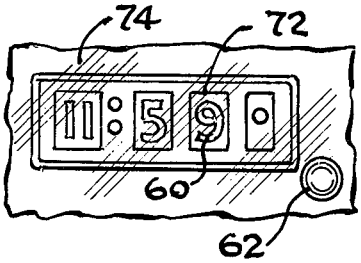
FIG. 7 is a fragmentary front view of the portion of the clock bezel through which the numerals are exposed.

The purpose of the indexing feature is to cause the numerals 60 on the drum 18 to be properly displayed, vertically centered in the aperture 72 of the bezel 74 through which they are exposed to view, as seen in FIG. 7. The relation of the numerals 60 with respect to the recesses 56, and with respect to the viewing aperture 72, is predetermined so that the desired orientation of the numerals in the aperture occurs when projections 54 engage in any pair of recesses 56. Without any particular effort or attention on the part of the user, the objective is attained by utilization of the present invention because it is "human engineered" in a way to accomplish the result. This is explained by the fact that when the user applies sufficient torque to force the detent projections out of the recesses, the torque required is considerably more than is necessary to rotate the minute drum with the projections sliding along the smooth surface of the web 58 between the recesses. Therefore, when the detent projections "pop" out of the recesses, the muscle tension which has been built up is such that the transit to the next set of recesses is made very quickly, and the user could hardly relax his grip in time to stop at an intermediate point even if he desired to do so. The result is that a user will normally stop at a properly indexed position with no special effort to that end.

Figure 5:
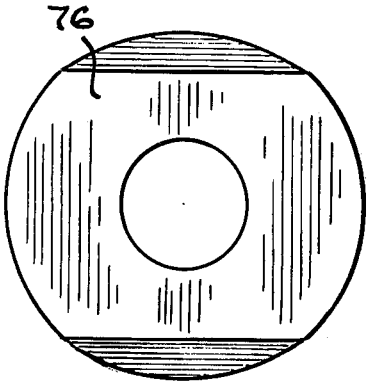
FIG. 5 is an illustration of a spring washer such as may be employed in place of the coil spring shown in FIG. 2.
Figure 6:
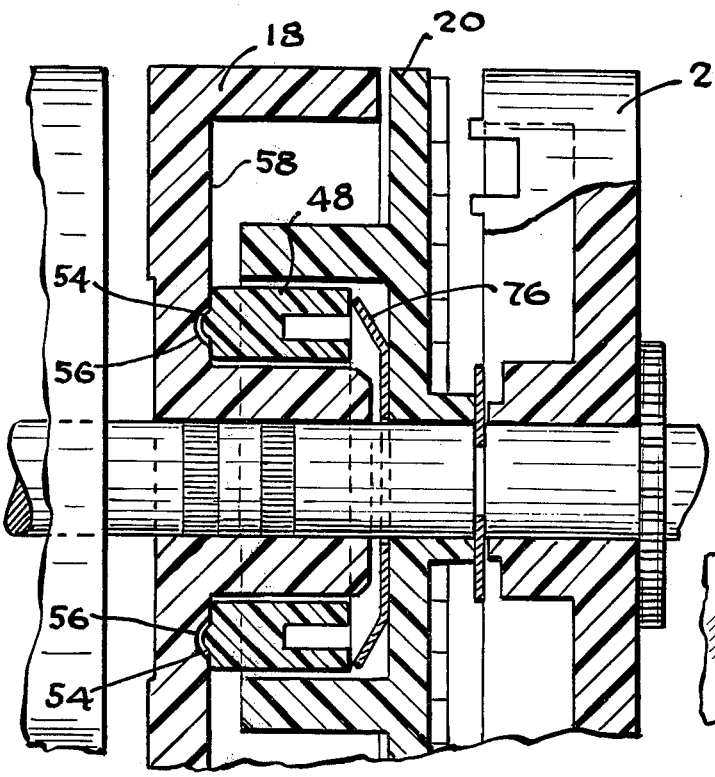
FIG. 6 is an enlarged sectional view, similar to that of FIG. 2, but showing the use of the spring washer instead of a coil spring.

The axial spring bias effective on the detent ring can be provided in various ways. FIG. 6 shows an alternate form of construction in which a spring washer 76 is employed to exert a biasing force on the detent ring 48, tending to move it toward the web 58 of the minute drum, i.e., serving the same purpose as the coil spring 52 in FIG. 2. Spring washers are available in various styles; one which is applicable to this usage is shown in section in FIG. 6 and in plan in FIG. 5.

The foregoing description of the invention is only illustrative of specific forms which the invention may take. Other modifications and variations will suggest themselves to persons skilled in the art. It is intended therefore that the detailed description be considered as exemplary only, and that the scope of the invention be ascertained from the following claims.

That which is claimed is:

1. In a setting mechanism for a digital clock having a plurality of time indicating drums supported for rotation in axially spaced relation to one another, the combination comprising rotating means adjacent to one of said drums and rotationally advanced at periodic time intervals, said one of said drums constituting a driven member, yieldable indexing means through which said rotational advancement of said rotating means can similarly advance said driven member, said indexing means comprising a detent member rotating with said rotating means and spring-biased toward said driven member, one of said member having projections thereon, and the other thereof having recesses equiangularly spaced therein, said projections being engageable in said drum, for driving engagement of said driven member by said detent member, and setting means adapted to rotate said driven member independently of said indexing means by the application through said setting means to said driven member of sufficient torque to cause said projections to be forced out of said recesses.

2. A setting mechanism in accordance with claim 1 wherein said detent member is axially movable relative to said one of said drums.

3. A setting mechanism in accordance with claim 1, wherein said projections are even in number and located in a pair or pairs in diametrically opposite and symmetrical positions with respect to the axis of rotation of said one of said drums.

4. A setting mechanism for a drum-type digital clock having a minute drum with a central web, fixed to and rotating with a shaft, comprising in combination a drive disc mounted on and rotatable with respect to said shaft, a detent member keyed to the drive disc for rotation therewith, but having limited axial freedom with respect to both the drive disc and the minute drum, resilient means pressing said detent member toward the web of said minute drum, mating surfaces on said web of said minute drum and on the adjacent face of said detent member, said mating surfaces being adapted to interfit at a fixed number of rotated positions of said minute drum with respect to said detent member, actuating means adapted to advance the drive disc each minute, and setting means engageable with said shaft, adapted to rotate said minute drum independently of said detent member by the application of sufficient torque to said minute drum to force said mating surfaces to withdraw from interfitting relation.

5. A setting mechanism for a drum-type digital clock having a drum with a central web, mounted on a shaft, comprising in combination drive means rotatable with respect to said shaft, a detent member keyed to the drive means for rotation therewith, but capable of axial movement with respect to said drive means and said drum, resilient means biasing said detent member toward the web of said drum, a boss projecting axially from said detent member and engageable with any of a plurality of recesses in the web of said drum, actuating means adapted to advance the drive means periodically, and to restrain the drive means against rotation between advance periods, and setting means adapted to rotate said drum independently of said detent member by the application of sufficient torque to said drum to force said boss to withdraw from engagement with said recesses.

6. A setting mechanism in accordance with claim 5, having a plurality of bosses projecting from said detent member.

7. A setting mechanism in accordance with claim 6, wherein said bosses are even in number and located in a pair in diametrically opposite and symmetrical positions with respect to said shaft.

8. A setting mechanism in accordance with claim 5 wherein said combination includes said drum, said drum having numeric indicia on its periphery at uniformly spaced intervals, and a bezel supported in fixed position with respect to said drum said bezel having an aperture therein sized for display therethrough of individual ones of said numeric indicia.

9. A setting mechanism in accordance with claim 8, wherein said drive means, said boss and said recesses in the web of said drum are so related dimensionally that when said drive means is at rest between advance periods, and said boss is engaged in any of said recesses, an individual one of said numeric indicia will be displayed through said aperture in substantially centered relation thereto.

10. A setting mechanism in accordance with claim 5 wherein said boss slides along a circular path on said web of said drum between said recesses therein, upon actuation of said setting means, and the surface of said web in said path is smooth.

11. A setting mechanism in accordance with claim 10 wherein greater torque is required to be applied to said drum by said setting means to force said boss to withdraw from engagement with said recesses than is required to move said boss along said circular path between said recesses.

* * * * *